United States Patent [19]

Baxendell et al.

[11] Patent Number: 4,947,214

[45] Date of Patent: Aug. 7, 1990

[54] TRANSFER APPARATUS

[75] Inventors: Douglas J. Baxendell, Rochester; Michael J. Cortash, Walworth; William G. Osbourne, Webster, all of N.Y.; Robert L. Thompson, Downingtown, Pa.

[73] Assignee: Xerox Corporation, Stamford, Conn.

[21] Appl. No.: 295,427

[22] Filed: Jan. 10, 1989

[51] Int. Cl.[5] ..... G03G 15/00; G03G 15/16

[52] U.S. Cl. ..... 355/274; 355/271; 355/273; 355/309; 355/316

[58] Field of Search ..... 355/271, 273, 274, 276, 355/277, 281, 308, 309, 312, 316, 317

[56] References Cited

U.S. PATENT DOCUMENTS

| | | | |
|---|---|---|---|
| 4,060,320 | 11/1977 | Doi et al. | 355/315 |
| 4,101,212 | 7/1978 | Sumiyoshi et al. | 355/274 |
| 4,341,456 | 7/1982 | Iyer et al. | 355/274 |
| 4,351,601 | 9/1982 | Cormier et al. | 355/315 |
| 4,420,243 | 12/1983 | Baker et al. | 355/315 |
| 4,447,652 | 5/1984 | Masuda et al. | 355/309 X |
| 4,699,496 | 10/1987 | John et al. | 355/277 |
| 4,739,362 | 4/1988 | Kau et al. | 355/277 |
| 4,839,697 | 6/1989 | Kamitamari et al. | 355/309 |
| 4,862,215 | 8/1989 | Nomura et al. | 355/309 |
| 4,882,606 | 11/1989 | Deguchi | 355/309 L |

*Primary Examiner*—A. C. Prescott

*Attorney, Agent, or Firm*—H. Fleischer; J. E. Beck; R. Zibelli

[57] ABSTRACT

An apparatus which transfers a developed image from a photoconductive surface to a copy sheet. The apparatus includes a corona generating device arranged to charge the copy sheet. This establishes a transfer field that is effective to attract the developed image from the photoconductive surface to the copy sheet. A blade is moved from a nonoperative position spaced from the copy sheet, to an operative position, in contact therewith. The blade presses the copy sheet into contact with at least the developed image on the photoconductive surface to substantially eliminate any spaces between the copy sheet and the developed image during transfer of the developed image from the photoconductive surface to the copy sheet.

30 Claims, 3 Drawing Sheets

TRANSFER APPARATUS

This invention relates generally to an electrophotographic printing machine, and more specifically concerns an apparatus for transferring a developed image from a photoconductive surface to a copy sheet.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image forming a toner powder image on the photoconductive member. The toner powder image is then transferred from the photoconductive member to a copy sheet. Heat is applied to the toner particles to permanently affix the powder image to the copy sheet.

High speed commercial printing machines of the foregoing type handle a wide range of differing weight copy sheets. The beam strength of the copy sheet is a function of the weight of the sheet. Heavier weight copy sheets have greater beam strength than lighter weight copy sheets. Inasmuch as the sheet conveying system of the printing machine handles a wide range of differing weight copy sheets, it is not unusual for the copy sheet to be wrinkled before it is transported to the processing station where the developed image is transferred to the copy sheet. The stack of copy sheets placed in the sheet feeder may be initially wrinkled, or the copy sheets may become wrinkled as they are fed from the stack to the transfer station. At the transfer station, the copy sheet adheres to the photoconductive member. In the event the copy sheet is wrinkled, it is not held in intimate contact with the photoconductive surface, but rather spaces occur between the developed image on the photoconductive surface and the copy sheet. In the electrostatic transfer of the toner powder image to the copy sheet, it is necessary for the copy sheet to be in uniform, intimate contact with the toner powder image developed on the photoconductive surface. Failure to do so results in variable transfer efficiency and, in the extreme, areas of low or no transfer resulting in image deletions. Clearly, an image deletion is very undesirable in that useful information and indicia are not reproduced on the copy sheet. Various methods have been used to minimize the incidence of image deletions. Hereinbefore, mechanical devices, such as rollers, have been used to press the copy sheet against the toner powder image on the photoconductive surface. For example, in the 9000 family of electrophotographic printing machines manufactured by the Xerox Corporation, an electrically biased transfer roll system is effective in substantially eliminating these image deletion. In other electrophotographic printing machines, such as the Model No. 1065, manufactured by the Xerox Corporation, the bend in the copy sheet as it enters the transfer station is precisely controlled. These and other types of devices illustrating the background of this technology are described in exemplary patents. U.S. Pat. No. 3,811,670 issued to Inoue in 1974 describes a flexible baffle attached to the wall of a corona generator pressing the transfer medium against the powder image formation member. U.S. Pat. No. 3,850,519 issued to Weikel, Jr. in 1974 describes a baffle having an elongated body pivotably mounted at one end on a pin, and an extended arm which projects between the shield of the corona generator and the photoreceptor surface. The upper surface of the baffle is arranged to engage the bottom surface of the copy sheet being forwarded into the transfer station so as to direct the copy sheet into contact with the photoreceptor. The extended arm of the baffle shields the region from the corona stream to assure that the sheet is well seated against the photoreceptor surface prior to being exposed to the corona stream. U.S. Pat. No. 4,190,348 issued to Friday in 1980 discloses an electrically biased transfer roller which presses the copy sheet into positive engagement with the surface of the photoreceptor. U.S. Pat. No. 4,110,024 issued to Gundlach in 1978 describes a corona pervious web and corona discharge electrodes. As the leading edge of the receiving sheet advances into the transfer zone, the corona discharge electrode is energized and imparts a substantially uniform charge to the backside of the receiving sheet. The corona pervious web insures that the receiving sheet is in substantially continuous contact with the photoreceptor surface.

The following disclosures appear to be relevant: U.S. Pat. No. 4,060,320. Patentee: Doi et al. Issued: Nov. 29, 1977. U.S. Pat. No. 4,341,456. Patentee: Iyer et al. Issued: Jul. 27, 1982. U.S. Pat. No. 4,351,601. Patentee: Cormier et al. Issued: Sept. 28, 1982. U.S. Pat. No. 4,420,243. Patentee: Baker et al. Issued: Dec. 13, 1983. U.S. Pat. No. 4,739,362. Patentee: Kau et al. Issued: Apr. 19, 1988.

The relevant portions of the foregoing patents may be summarized briefly as follows:

U.S. Pat. No. 4,060,320 describes a paper separating device that uses flexible elastic polyester film as blade members. The edge of the blade contains Nylon fibers to reduce contact with the photoreceptor surface and subsequent damage thereto.

U.S. Pat. No. 4,341,456 discloses a transfer system using a flexible brush having conductive bristles. The leading edge of the copy sheet will deflect the bristles causing them to bend and contact the back side of the paper as the paper is moved into contact with the toner image on the photoreceptor. A voltage source electrically biases the brush bristles. As the copy sheet continues to move toward the photoreceptor, a light sensing device detects the trailing edge of the copy sheet. A signal is sent to a delay circuit and a delayed signal sent to a solenoid to cause the solenoid to be momentarily actuated to move the bristles out of contact with the back side of the copy sheet immediately before the trailing edge of the copy sheet moves out of contact with the photoreceptor. This prevents the brush bristles from contacting the photoreceptor and collecting toner which would be passed onto subsequent copy sheets.

U.S. Pat. No. 4,351,601 describes a sheet hold down arrangement having a support member that exerts a force on the paper holding it onto the photoreceptor surface.

U.S. Pat. No. 4,420,243 discloses a hold down finger that engages the back side of the copy sheet as it passes through the transfer station to ensure that as nearly complete a copy as is possible is made.

U.S. Pat. No. 4,4739,362 describes an upper and lower baffle though which a sheet is passes. The upper baffle is mounted pivotably and normally is biased by its own weight against the lower baffle. The weight of the upper baffle serves to aid in imparting a bow corresponding to the curvature of the end of the lower baffle by biasing the sheets against the flanged portion and the curved sheet supporting surface as the sheets pass between the two baffle members. This reduces the sheet spring force required to smooth the sheet and permits better contact between the trailing edge of the sheet and the photoreceptor.

In accordance with one aspect of the present invention, there is provided an apparatus for transferring a developed image from a photoconductive surface to a copy sheet. The apparatus includes means for charging the copy sheet to attract the developed image from the photoconductive surface to the copy sheet. Means, adapted to move from a non-operative position spaced from the copy sheet to an operative position contacting the copy sheet, press the copy sheet into contact with at least the developed image on the photoconductive surface in the region of the charging means to substantially eliminate any spaces between the copy sheet and the developed image.

Pursuant to another aspect of the features of the present invention, there is provided an electrophotographic printing machine of the type in which a developed image is transferred from a photoconductive surface to a copy sheet at a transfer station. The improved printing machine includes a charging element, positioned at the transfer station, for charging the copy sheet to establish a transfer field that is effective to attract the developed image from the photoconductive surface to the copy sheet. A pressing member, adapted to move from a non-operative position spaced from the copy sheet to an operative position contacting the copy sheet, presses the copy sheet into contact with at least the developed image on the photoconductive surface in the transfer station to substantially eliminate any spaces between the copy sheet and the developed image.

The present invention is also concerned with a method of transferring a developed image from a photoconductive surface to a copy sheet at a transfer station. The method of transfer includes the steps of establishing, at the transfer station, a transfer field that is effective to attract the developed image from the photoconductive surface to the copy sheet. A blade is moved from a non-operative position, spaced from the copy sheet, to an operative position, contacting the copy sheet, to press the copy sheet into contact with at least the developed image on the photoconductive surface in the transfer station. This substantially eliminates any spaces between the copy sheet and the developed image.

Other aspects of the present invention will become apparent as the following description proceeds and upon reference to the drawings, in which.

While the present invention will hereinafter be described in connection with a preferred embodiment and method of use, it will be understood that it is not intended to limit the invention to that embodiment or method of use. On the contrary, it is intended to cover all alternatives, modifications, and equivalents, as may be included within the spirit and scope of the invention as defined by the appended claims.

Figure 1:
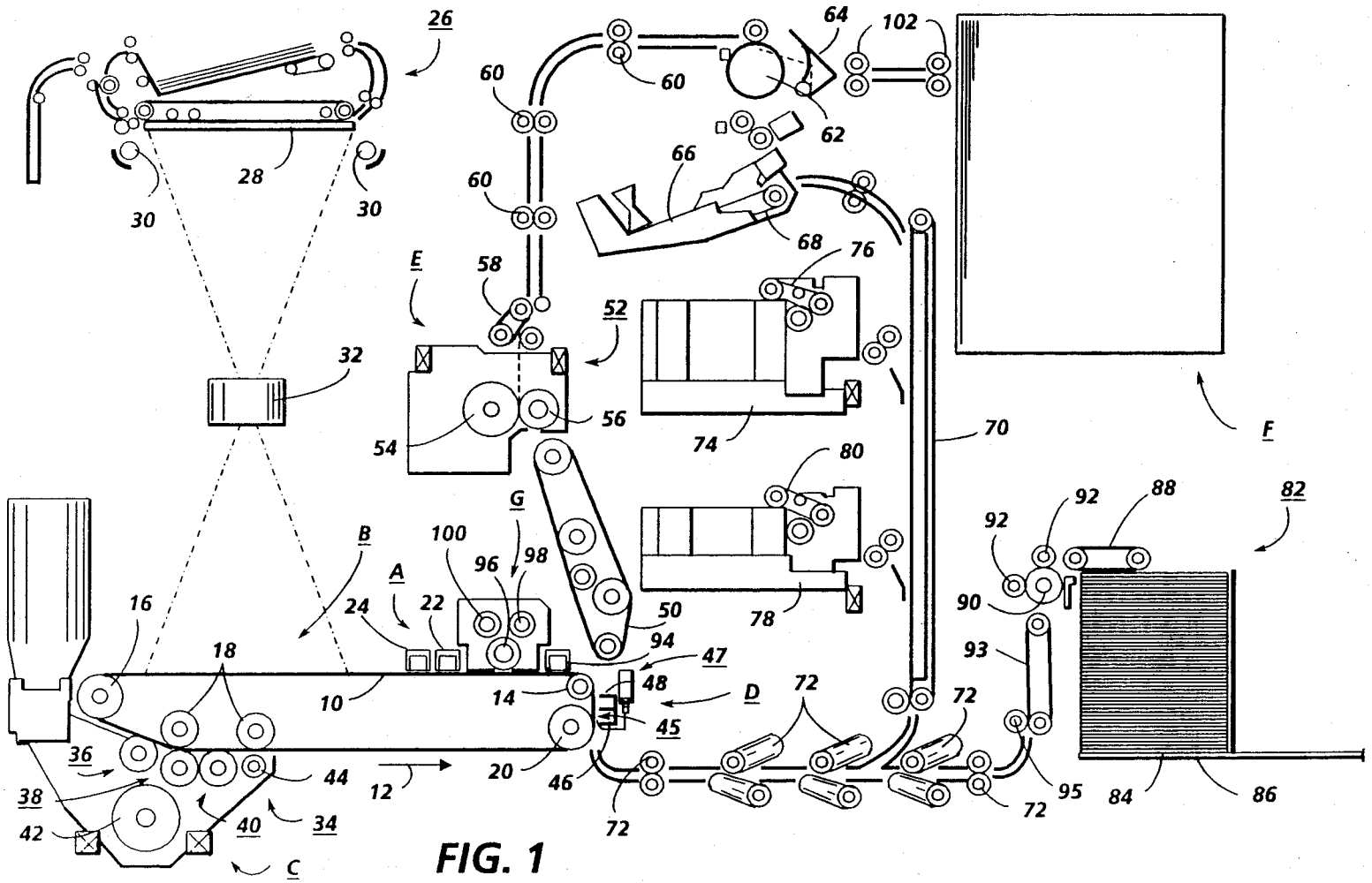
FIG. 1 is a schematic elevational view depicting an illustrative electrophotographic printing machine incorporating the apparatus of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the apparatus of the present invention may be employed in a wide variety of electrostatographic printing machines and is not specifically limited in its application to the particular embodiment or method of use described herein.

Referring now to FIG. 1 of the drawings, the electrophotographic printing machine employs a photoconductive belt 10. Preferably, the photoconductive belt 10 is made from a photoconductive material coated on a ground layer, which, in turn, is coated on an anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, rollers 18, and drive roller 20. Stripping roller 14 and rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of photoconductive belt 10 passes through charging station A. At charging station A, two corona generating devices, indicated generally by the reference numerals 22 and 24 charge photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of photoconductive belt 10 is advanced through imaging station B. At imaging station B, a document handling unit, indicated generally by the reference numeral 26, is positioned over platen 28 of the printing machine. Document handling unit 26 sequentially feeds documents from a stack of documents placed by the operator in the document stacking and holding tray. The original documents to be copied are loaded face up into the document tray on top of the document handling unit. A document feeder, located below the tray, feeds the bottom document in the stack to rollers. The rollers advance the document onto platen 28. When the original document is properly positioned on platen 28, a belt transport is lowered onto the platen with the original document being interposed between the platen and the belt transport. After imaging, the original document is returned to the document tray from platen 28 by either of two paths. If a simplex copy is being made or if this is the first pass of a duplex copy, the original document is returned to the document tray via the simplex path. If this is the inversion pass of a duplex copy, then the original document is returned to the document tray through the duplex path. Imaging of a document is achieved by two Xenon flash lamps 30 mounted in the optics cavity which illuminate the document on platen 28. Light rays reflected from the document are transmitted through lens 32. Lens 32 focuses the light image of the original document onto the charged portion of the photoconductive surface of belt 10 to selectively dissipate the charge thereon. This records an electrostatic latent image on photoconductive belt 10 which corresponds to the informational areas contained within the original document. Thereafter, photoconductive belt 10 advances the electrostatic latent image recorded thereon to development station C.

At development station C, a magnetic brush developer unit, indicated generally by the reference numeral 34, has three developer rolls, indicated generally by the reference numerals 36, 38 and 40. A paddle wheel 42 picks up developer material and delivers it to the developer rolls. When developer material reaches rolls 36 and 38, it is magnetically split between the rolls with half of the developer material being delivered to each roll. Photoconductive belt 10 is partially wrapped about rolls 36 and 38 to form extended development zones. Developer roll, 40 is a cleanup roll. Magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. The copy sheet is frequently wrinkled. First, photoconductive belt 10 is exposed to a pre-transfer light from a lamp (not shown) to reduce the attraction between photoconductive belt 10 and the toner powder image. The copy sheet is advanced along the sheet path and pressed into contact with the toner powder image on photoconductive surface 12 by a blade, indicated generally by the reference numeral 45. Blade 45 is moved from the non-operative position, spaced from the copy sheet and photoconductive belt to the operative position in contact with the back side of the copy sheet. Solenoids, indicated generally by the reference numeral 47, move blade 45 between the operative and non-operative positions. A light sensor detects the leading edge of the copy sheet as it enters transfer station D. The signal from the light sensor is processed by a circuit and used to control the actuation of solenoids 47. Energization of solenoids 47 move blade 45 from the non-operative position to the operative. In the operative position, blade 45 presses the copy sheet into contact with the toner powder image developed on photoconductive belt 10. This substantially eliminates any spaces between the copy sheet and the toner powder image. The continuous pressing of the sheet into contact with the toner powder image at the transfer station insures that the copy sheet is substantially wrinkle free at the transfer station. Corona generating device 46 charges the copy sheet to the proper magnitude and polarity so that the copy sheet is tacked to photoconductive belt 10 and the toner powder image attracted from the photoconductive belt to the copy sheet. In this way, the copy sheet moves with photoconductive belt 10, in the direction of arrow 12. As the trailing edge of the copy sheet passes the light sensor, the light sensor transmits a signal to a processing circuit which introduces a delay and, after the delay, transmits a signal de-energizing solenoids 47. As exemplary type of light sensor and delay circuit is descried in U.S. Pat. No. 4,341,456 issued to Iyer et al. in 1982, the relevant portions thereof being hereby incorporated into the present application. When solenoids 47 are de-energized, blade 45 moves from the operative position to the non-operative position. In the non-operative position, blade 45 is spaced from the copy sheet and the photoconductive belt. This insures that blade 45 does not scratch the photoconductive belt or accumulate toner particles thereon which are deposited on the backside of the next successive copy sheet. Further details of this apparatus will be described hereinafter with reference to FIG. 2.

After transfer, corona generator 48 charges the copy sheet to the opposite polarity to detack the copy sheet from belt 10. As belt 10 continues to move in the direction of arrow 12, the beam strength of the copy sheet causes the copy sheet to separate from belt 10. Conveyor 50, positioned to receive the copy sheet, advances it to fusing station E.

Fusing station E includes a fuser assembly, indicated generally by the reference numeral 52, which permanently affixes the transferred toner powder image to the copy sheet. Preferably, fuser assembly 52 includes a heated fuser roller 54 and a pressure roller 56 with the powder image on the copy sheet contacting fuser roller 54. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent is transferred to a donor roll and then to the fuser roll.

After fusing, the copy sheets are fed through a decurler 58. Decurler 58 bends the copy sheet in one direction to put a known curl in the copy sheet and then bends it in the opposite direction to remove that curl.

Forwarding roller pairs 60 then advance the sheet to duplex turn roll 62. Duplex solenoid gate 64 guides the sheet to the finishing station F or to duplex tray 66. In the finishing station, the copy sheets are collected in sets with the copy sheets of each set being stapled or glued together. Alternatively, duplex solenoid gate 64 diverts the sheet into duplex tray 66. The duplex tray 66 provides an intermediate or buffer storage for those sheets that have been printed on one side and on which an image will be subsequently printed on the second, opposed side thereof, i.e. the sheets being duplexed. The sheets are stacked in duplex tray 66 face down on top of one another in the order in which they are copied.

In order to complete duplex copying, the simplex sheets in tray 66 are fed, in seriatim, by bottom feeder 68 from tray 66 back to transfer station D via conveyor 70, and rollers 72, for transfer of the toner powder image to the opposed sides of the copy sheets. Once again solenoids 47 are energized to move blade 45 from the non-operative position to the operative position. After the copy sheet exits the transfer station, solenoids 47 are de-energized and blade 45 returns to the non-operative position. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 74. Secondary tray 74 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 76. Sheet feeder 76 is a friction retard feeder utilizing a feed belt and take-away rolls to advance successive copy sheets to transport 70 which advances the sheets to rolls 72 and then to transfer station D.

Copy sheets may also be fed to transfer station D from the auxiliary tray 78. The auxiliary tray 78 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 80. Sheet feeder 80 is a friction retard feeder utilizing a feed belt and take-away rolls to advance successive copy sheets to transport 70 which advances the sheets to rolls 72 and then to transfer station D.

Secondary tray 74 and auxiliary tray 78 are secondary sources of copy sheets. A high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray to transfer station D. A vacuum feed belt 88 feeds successive uppermost sheets from the stack to a take away roll 90 and rolls 92. The take-away roll 90 and rolls 92 guide the sheet onto transport 93. Transport 93 and roll 95 advance the sheet to rolls 72 which, in turn, move the sheet into the transfer zone at transfer station D.

Invariably, after the copy sheet is separated from photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 96 and two de-toning rolls 98 and 100, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

Figure 2:
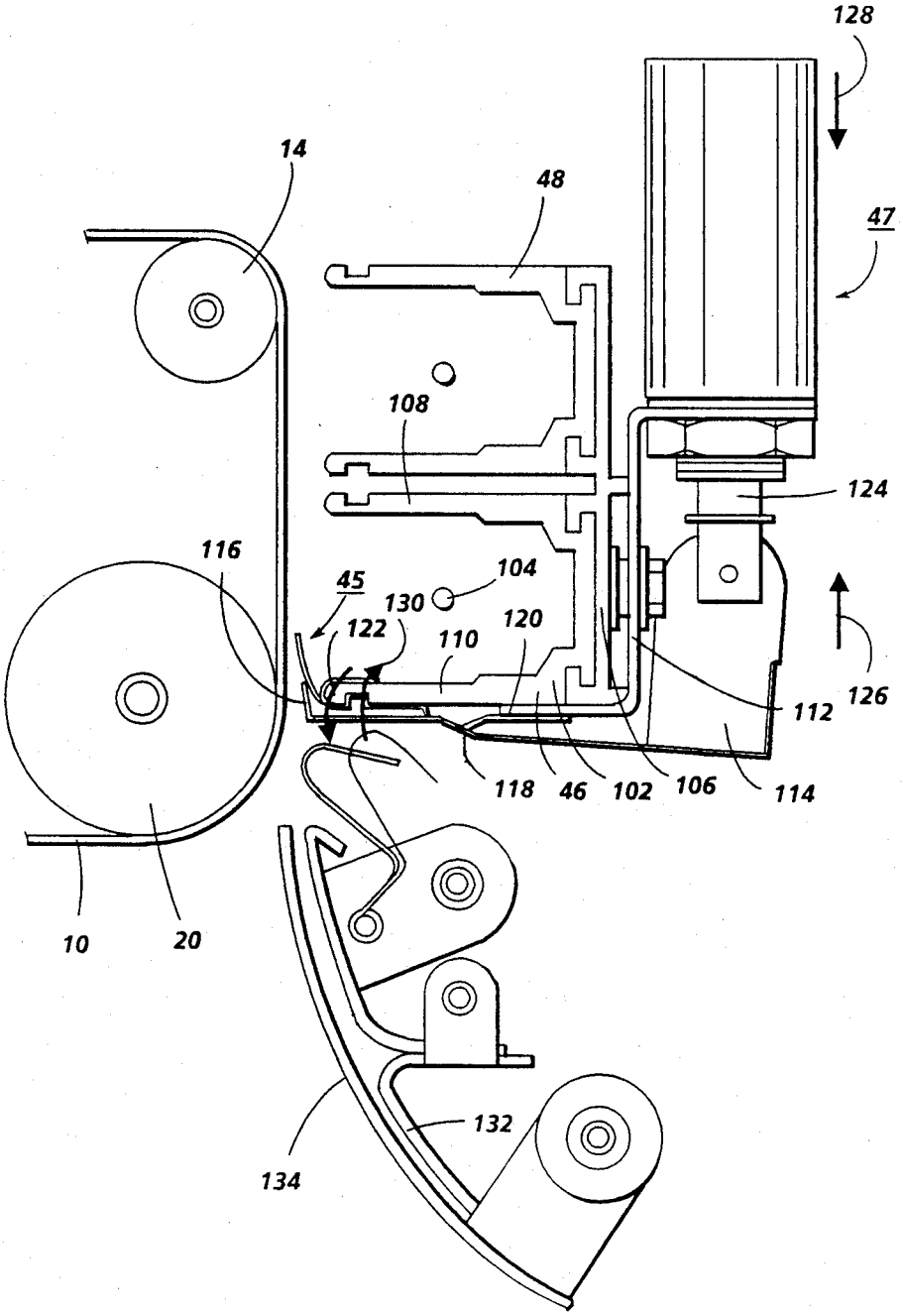
FIG. 2 is an elevational view showing the blade and actuation mechanism used in the FIG. 1 printing machine to press the copy sheet against the developed image in the transfer station.

Referring now to FIG. 2, there is shown an elevational view further illustrating the features of the present invention. As shown thereat, corona generating device 46 includes a generally U-shaped shield, indicated generally by the reference numeral 102, and an elongated electrode wire 104. Shield 102 has a back wall 106 and opposed, spaced side walls 108 and 110 secured thereto. One skilled in the art will appreciate that any suitable corona generating device may be employed. For example, the electrode of the corona generator may be spaced pins, or the shield may only have side walls and no back wall. Corona generating device 46 is energized to charge the copy sheet. The charged copy 114 sheet attracts the toner powder image thereto from photoconductive belt 10.

One marginal region of blade 45 is secured to the free marginal end region of side wall 110. Bracket 112 has solenoids 47 mounted thereon and, is in turn, secured to back wall 106. Lever arm 114 has one end thereof secured to solenoid 47. The free end 116 of lever arm 114 contacts blade 45. Lever arm 114 is attached to bracket 112 at point 118 by a flat leaf spring 120. In this way, energization of solenoid 47 pivots lever arm 114 about point 118 in a counter clockwise direction as shown by arrow 122. When energized, plunger 124 of solenoid 47 translates in the direction of arrow 126. Since lever arm 114 pivots about point 118, end 116 pivots in the direction of arrow 122 permitting blade 45 to flex or pivot from the non-operative position to the operative position against the back of the copy sheet. After the trailing edge of the copy sheet has been detected and the signal suitably delayed, solenoid 47 is de-energized causing plunger 124 to move in the direction of arrow 128. End 116 of lever arm 14 now pivots in the direction of arrow 130. As end 116 pivots in the direction of arrow 130, it contacts blade 45. Blade 45 deflects from the operative position to the non-operative position. In operation, baffles 132 and 134 guide the copy sheet into the transfer station. A light sensor detects the leading edge of the copy sheet entering the transfer station and transmits a signal to processing circuitry. The processing circuitry energizes solenoids 47. Energization of solenoids 47 translates plungers 124 in the direction of arrow 126 pivoting lever arm 114 in the direction of arrow 122. As end 116 of lever arm 114 pivots in the direction of arrow 122, blade 45 moves from the deflected, non-operative position to the undeflected, operative position. In the operative position, the free end of blade 45 contacts the back of the copy sheet and presses the copy sheet against the developed toner powder image on photoconductive belt 10. This substantially eliminates any spaces between the copy sheet and the toner powder image substantially improving transfer of the toner powder image to the copy sheet. Under these circumstances, the toner powder image transferred to the copy sheet is substantially deletion free. After the light sensor detects the trailing edge of the copy sheet, the processing circuit, after a suitable delay, transmits a signal to the solenoid 47. This signal de-energizes solenoid 47. De-energization of solenoid 47 causes end 116 of lever arm 114 to pivot in the direction of arrow 130. As end 116 pivots in the direction of arrow 130, it contacts blade 45 and deflects it from the operative position to the non-operative position. Preferably, blade 45 is made from a thin, flat polyester sheet which is elastically deformed to an arcuate shape. In this way, blade 45 always exerts a force toward photoconductive belt 10. This force must be opposed by end 116 of lever arm 114 to hold the blade in the non-operative position. As the copy sheet passes thorough the transfer station, lever arm 114 pivots end 116 away from blade 45 and blade 45 flexes or pivots to press the sheet into intimate contact with the toner powder image on photoconductive belt 10. This insures that the toner powder image transferred to the copy sheet is substantially free of deletions.

Figure 3:
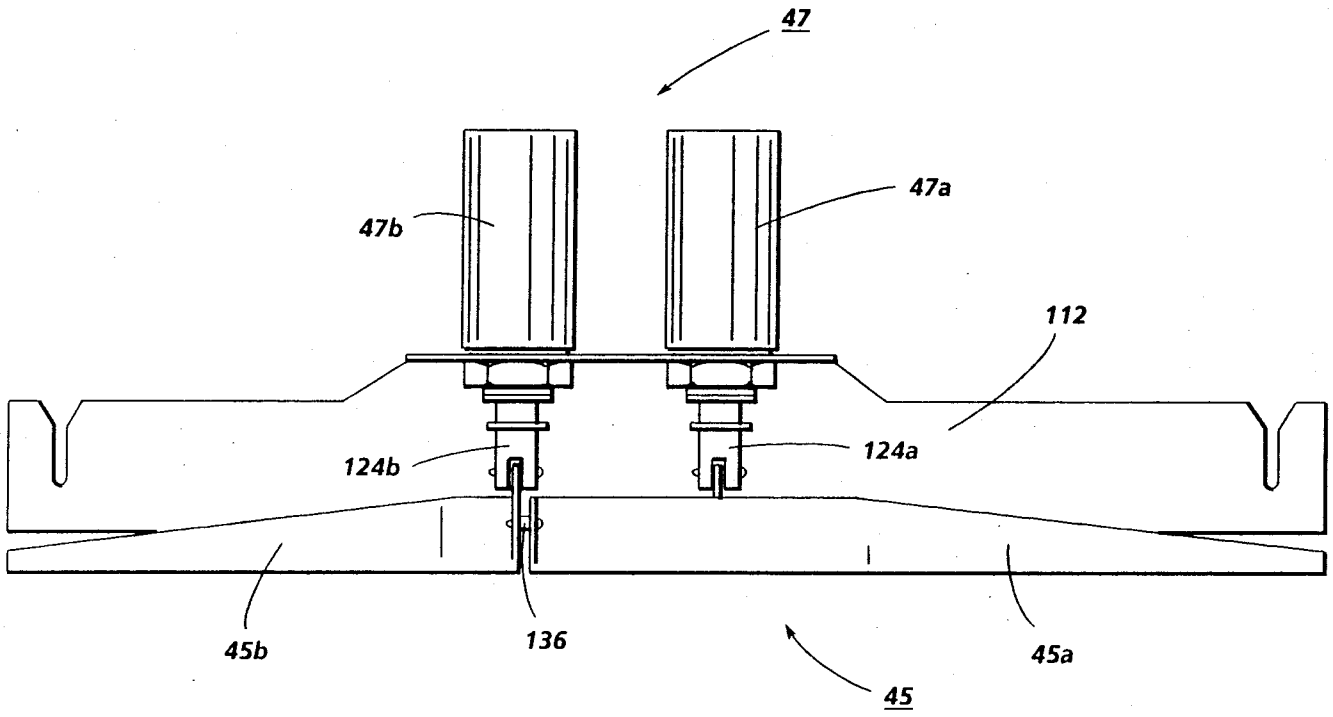
FIG. 3 is a plan view illustrating the FIG. 2 blade and actuation mechanism.

Turning now to FIG. 3, there is shown blade 45 in greater detail. As shown thereat, blade 45 includes portions 45*a* and 45*b*. Solenoids 47 includes solenoid 47*a* having plunger 124*a* connected to blade portion 45*a* and solenoid 47*b* having plunger 124*b* connected to blade portion 45*b*. Pin 136 extends outwardly from one end of blade portion 45*a* and is mounted slidably in the opposed end of blade portion 45*b*. Energization of solenoid 47*a* moves blade portion 45*a* from the non-operative position to the operative position with blade portion 45*b* remaining at the non-operative position. Thus, if the copy sheet is $8\frac{1}{2}\times 11$ inches, only solenoid 47*a* is energized, and only blade portion 45*a* moves from the non-operative position to the operative position. In contradistinction, if the copy sheet is $8\frac{1}{2}\times 14$ inches, solenoid 47*b* is energized. Energization of solenoid 47*b* moves blade portion 45*b* which engages pin 136 to move blade portion 45*a*. Thus, energization of solenoid 47*b* moves blade portion 45*a* and blade portion 45*b* from the non-operative position to the operative position.

In recapitulation, the transfer apparatus of the present invention includes a blade member, normally spaced from the photoconductive surface, in the non-operative position, which moves to an operative position pressing the copy sheet into intimate contact with the toner powder image developed on the photoconductive belt. This insures that the copy sheet is placed in intimate contact with the toner powder image on the photoconductive surface. A corona generating device generates a transfer field effective to transfer the toner powder image from the photoconductive belt to the copy sheet without deletions.

It is, therefore, evident that there has been provided, in accordance with the present invention, an apparatus that fully satisfies the aims and advantages hereinbefore set forth. While this invention has been described in conjunction with a preferred embodiment and method of use, it is evident that many alternatives, modifications, and variations will be apparent to those skilled in the art. Accordingly, it is intended to embrace all such alternatives, modifications and variations as fall within the spirit and broad scope of the appended claims.

We claim:

1. An apparatus for transferring a developed image from a moving photoconductive surface to a moving copy sheet of a selected size, including:

means for charging the copy sheet to attract the developed image from the photoconductive surface to the copy sheet; and means, adapted to move from a non-operative position spaced from the copy sheet to an operative position contacting the copy sheet, for pressing the copy sheet into contact with at least the developed image on the photoconductive surface in the region of said charging means to substantially eliminate any spaces between the copy sheet and the developed image, said pressing means, in response to the selected size of the copy sheet, being adjustable to extend from at least one side of the copy sheet to at least the other side of the copy sheet in a direction substantially normal to the direction of movement of the copy sheet.

2. An apparatus according to claim 1, wherein said pressing means includes:

a blade member; and means for movably supporting said blade member, said supporting means being adapted to move said blade member from the inoperative position wherein said blade member is spaced from the copy sheet to the operative position wherein said blade member presses the copy sheet into contact with the developed image on the photoconductive surface 3. An apparatus according to claim 2, wherein said supporting means moves said blade member from the inoperative position to the operative position in response to the leading edge of the copy sheet contacting the developed image on the photoreceptor surface.

4. An apparatus according to claim 3, wherein said supporting means moves said blade member from the operative position to the inoperative position in response to the trailing edge of the copy sheet being spaced from said blade member.

5. An apparatus according to claim 3, wherein said supporting means includes:

a first solenoid coupled to a first portion of said blade member; and a second solenoid coupled to a second portion of said blade member with said first portion of said blade member being coupled to said second portion of said blade member so that energization of said first solenoid moves said first portion of said blade member from the non-operative position to the operative position and energization of said second solenoid moves the first portion and the second portion of said blade member from the non-operative position to the operative position with said first solenoid being energized for one copy sheet and said second solenoid being energized for another larger copy sheet.

6. An apparatus according to claim 4, wherein said supporting means includes at least a solenoid.

7. An apparatus according to claim 6, wherein said supporting means includes a pivotably mounted lever arm coupling said solenoid with said blade member.

8. An apparatus according to claim 7, wherein said charging means includes a corona generating device spaced from the photoconductive surface to define a gap therebetween through which the copy sheet passes.

9. An apparatus according to claim 8, wherein one marginal region of said blade member is mounted on said corona generating device.

10. An apparatus according to claim 9, wherein said corona generating device includes a shield comprising at least opposed, spaced side walls with said blade member being mounted on one of the side walls of said shield.

11. An apparatus according to claim 10, wherein said shield includes a back wall with said lever arm being mounted pivotably on the back wall of said shield with one marginal region of said lever arm being connected to said solenoid and the other marginal region thereof engaging said blade member so that de-energization of said solenoid pivots said lever arm causing the other marginal region thereof to deflect said blade member from the operative position to the non-operative position and energization of said solenoid said lever causing the other marginal region thereof to move away from said blade member enabling said blade member to move from the non-operative position to the operative position with said blade member being in a less deflected condition and pressing the copy sheet into contact with the developed image on the photoconductive surface.

12. An electrophotographic printing machine of the type in which a developed image is transferred from a moving photoconductive surface to a moving copy sheet of a selected size at a transfer station, wherein the improvement includes:

a charging element, positioned at the transfer station, for charging the copy sheet to establish a transfer field that is effective to attract the developed image from the photoconductive surface to the copy sheet; and a pressing member, adapted to move from a non-operative position spaced from the copy sheet to an operative position contacting the copy sheet, for pressing the copy sheet into contact with at least the developed image on the photoconductive surface in the transfer station to substantially eliminate any spaces between the copy sheet and the developed image, said pressing member, in response to the selected size of the copy sheet, being adjustable to extend from at least one side of the copy sheet to at least the other side of the copy sheet in a direction substantially normal to the direction of movement of the copy sheet.

13. A printing machine according to claim 12, wherein said pressing member includes:

a blade member; and an actuator movably supporting said blade member, said actuator being adapted to move said blade member from the inoperative position wherein said blade member is spaced from the copy sheet to the operative position wherein said blade member presses the copy sheet into contact with the developed image on the photoconductive surface 14. A printing machine according to claim 13, further including a sensing element mounted in the region of the transfer station for detecting the leading and trailing edge of the copy sheet.

15. A printing machine according to claim 14, wherein said actuator moves said blade member from the inoperative position to the operative position in response to said sensing element indicating that the leading edge of the copy sheet entered the transfer station.

16. A printing machine according to claim 14, wherein said actuator moves said blade member from the operative position to the inoperative position in response to said sensing element indicating that the trailing edge of the copy sheet exited from the transfer station.

17. A printing machine according to claim 14, wherein said actuator includes:

a first solenoid coupled to a first portion of said blade member; and a second solenoid coupled to a second portion of said blade member with the first portion of said blade member being coupled to the second portion of said blade member so that energization of said first solenoid moves the first portion of said blade member from the non-operative position to the operative position and energization of said second solenoid moves the first portion and the second portion of said blade member from the non-operative position to the operative position with said first solenoid being energized for one copy sheet and said second solenoid being energized for another larger copy sheet.

18. A printing machine according to claim 14, wherein said actuator includes at least a solenoid.

19. A printing machine according to claim 18, wherein said actuator includes a pivotably mounted lever arm coupling said solenoid with said blade member.

20. A printing machine according to claim 19, wherein said charging element includes a corona generating device spaced from the photoconductive surface to define a gap therebetween through which the copy sheet passes.

21. A printing machine according to claim 20, wherein one marginal region of said blade member is mounted on said corona generating device.

22. A printing machine according to claim 21, wherein said corona generating device includes a shield comprising at least opposed, spaced side walls with said blade member being mounted on one of the side walls of said corona generating device.

23. A printing machine according to claim 22, wherein said shield includes a back wall with said lever arm being mounted pivotably on the back wall of said shield with one marginal region of said lever arm being connected to said solenoid and the other marginal region thereof engaging said blade member so that de-energization of said solenoid pivots said lever arm causing the other marginal region thereof to deflect said blade member from the operative position to the non-operative position and energization of said solenoid pivots said lever arm causing the other marginal region thereof to move away from said blade member enabling said blade member to move from the non-operative position to the operative position with said blade member being in a less deflected condition and pressing the copy sheet into contact with the developed image on the photoconductive surface.

24. A method of transferring a developed image from a moving photoconductive surface to a moving copy sheet of a selected size at a transfer station, including the steps of:

establishing, at the transfer station, a transfer field that is effective to attract the developed image from the photoconductive surface to the copy sheet;

adjusting in response to the selected size of the copy sheet, a blade to extend from at least one side of the copy sheet to at least the other side of the copy sheet in a direction substantially normal to the direction of movement of the copy sheet, and moving the blade from a non-operative position position spaced from the copy sheet to an operative position contacting the copy sheet to press the copy sheet into contact with at least the developed image on the photoconductive surface in the transfer station to substantially eliminate any spaces between the copy sheet and the developed image.

25. A method according to claim 24, further including the step of detecting the leading and trailing edge of the copy sheet in the transfer station.

26. A method according to claim 25, wherein said step of moving the blade from the non-operative to the operative position occurs in response to said step of detecting the leading edge of the copy sheet.

27. A method according to claim 25, wherein said step of moving the blade from the operative to the non-operative position occurs in response to said step of detecting the trailing edge of the copy sheet.

28. A method according to claim 25, wherein said step of moving the blade includes the step of energizing a solenoid to pivot a lever arm away from the blade enabling the blade to move from the non-operative position to the operative position.

29. A method according to claim 28, wherein said step of moving the blade includes the step of de-energizing the solenoid to pivot the lever arm into engagement with the blade to deflect the blade from the non-operative position to the operative position.

30. A method according to claim 25, wherein said step of establishing a transfer field includes the step of charging the copy sheet.

* * * * *